US009759500B2

(12) United States Patent
Lakatos et al.

(10) Patent No.: US 9,759,500 B2
(45) Date of Patent: Sep. 12, 2017

(54) FIREARM BREECH SYSTEM

(71) Applicant: Triple Action L.L.C., Logan, UT (US)

(72) Inventors: Janos I Lakatos, Mendon, UT (US); Edward Clay Slade, North Logan, UT (US); Clayton R. Carter, North Logan, UT (US)

(73) Assignee: Triple Action, L.L.C., Logan, UT (US)

( * ) Notice: Subject to any disclaimer, the term of this patent is extended or adjusted under 35 U.S.C. 154(b) by 0 days.

(21) Appl. No.: 15/043,605

(22) Filed: Feb. 14, 2016

(65) Prior Publication Data

US 2017/0234632 A1 Aug. 17, 2017

(51) Int. Cl.

| | |
|---|---|
| ***F41A 3/04*** | (2006.01) |
| ***F41A 3/72*** | (2006.01) |
| ***F41A 15/08*** | (2006.01) |
| ***F41C 3/00*** | (2006.01) |

(52) U.S. Cl.
CPC *F41A 3/04* (2013.01); *F41A 3/72* (2013.01); *F41A 15/08* (2013.01); *F41C 3/00* (2013.01)

(58) Field of Classification Search
CPC ..... F41A 3/00; F41A 3/02; F41A 3/04; F41A 3/06; F41A 3/08
USPC ..... 89/17, 18, 22, 23, 25
See application file for complete search history.

(56) References Cited

U.S. PATENT DOCUMENTS 33,435 A * 10/1861 Joslyn ..... F41A 3/04 42/32
37,208 A * 12/1862 Strong ..... F41A 3/04 42/32
39,407 A * 8/1863 Joslyn ..... F41A 3/04 42/32
46,125 A * 1/1865 Milbank ..... F41A 3/06 42/27
49,491 A * 8/1865 Allen ..... F41A 3/04 42/32
151,458 A * 5/1874 Whitney ..... F41A 3/04 42/32
207,689 A * 9/1878 Soper ..... F41A 3/04 42/32
387,016 A * 7/1888 Snow ..... F41A 3/74 89/25
433,013 A * 7/1890 Lyons ..... F41A 3/74 89/25
451,865 A * 5/1891 Welin ..... F41A 3/08 89/21
520,029 A * 5/1894 Bergman ..... F41A 3/30 89/19
550,602 A * 12/1895 Driggs ..... F41A 3/10 89/22

(Continued)

*Primary Examiner* — Derrick Morgan

(74) *Attorney, Agent, or Firm* — Preston P. Frischknecht; Project CIP

(57) ABSTRACT

Embodiments of the present invention include a breech system comprising, first, a breech lock with a pivotable cam end plate for accessing a firearm breech and, second, a camming cartridge extractor with a pivotable lever for extracting a fired cartridge. The pivotable cam end plate may be connected to an independently pivotable arm that is operable as a lever for moving the cam end plate into an open position to allow breech access. The pivotable cam end plate and pivotable arm may be capable of a plurality of movements within the same plane in order to optimize leverage and cam action for opening the breech lock.

13 Claims, 11 Drawing Sheets

(56) References Cited

U.S. PATENT DOCUMENTS

| | | | | | |
|---|---|---|---|---|---|
| 628,870 | A | | 7/1899 | Tompkims | |
| 1,326,712 | A | | 12/1919 | Dawson | |
| 1,443,046 | A | * | 1/1923 | Schneider | F41A 3/08 89/17 |
| 2,466,714 | A | | 4/1949 | Kroeger | |
| 2,741,160 | A | | 4/1956 | Musser | |
| 2,807,195 | A | * | 9/1957 | Walton | F41A 1/08 42/25 |
| 2,817,173 | A | | 12/1957 | Grover | |
| 3,027,809 | A | * | 4/1962 | Walton | F41A 1/08 89/1.704 |
| 3,144,808 | A | | 8/1964 | Stapp | |
| 3,707,900 | A | * | 1/1973 | Hornfeck | F41A 3/74 89/23 |
| 4,121,364 | A | * | 10/1978 | Kaltenegger | F41A 3/04 42/32 |
| 4,267,764 | A | * | 5/1981 | Yaniger | F41A 3/04 42/106 |
| 4,308,785 | A | * | 1/1982 | Samuel | F41A 3/74 89/24 |
| 5,663,519 | A | * | 9/1997 | Muller | F41A 3/10 89/17 |
| 6,233,860 | B1 | | 5/2001 | Hazen | |
| 8,813,629 | B1 | * | 8/2014 | Holmes | F41A 3/06 89/18 |
| 2002/0133997 | A1 | * | 9/2002 | Kepner | F41A 3/10 42/23 |

* cited by examiner

FIREARM BREECH SYSTEM

BACKGROUND OF THE INVENTION

In the firearms industry, a niche exists for novel weapons, such as handguns that fire outsized cartridges like the .50 Browning Machine Gun (BMG). Designing a handgun for such powerful rounds requires a number of unique engineering innovations. For example, such firearms may require specialized recoil reduction mechanisms, such as found in U.S. Pat. No. 6,742,297. Additionally, cartridge extraction of such rounds from a handgun can prove difficult. Firing powerful rounds results in significant intra-chamber forces that create similarly outsized cartridge expansion. Extraction difficulty is exacerbated in this context because handgun components are relatively smaller and less robust than those found in bigger weapons for which these larger rounds are designed. The opening of breeches and subsequent extraction can prove irritating or difficult—in terms of investment of both time and/or effort.

Accordingly, there is a need in the outsized caliber handgun niche for a breech system that addresses the difficulty of first, opening a breech lock and second, extracting the used cartridge in connection with the ultra-pressurized environment found from cartridge expansion following a discharge event.

BRIEF SUMMARY OF THE INVENTION

Embodiments of the present invention include a breech system comprising, first, a breech lock with a pivotable cam end plate for accessing a firearm breech and, second, a camming cartridge extractor with a pivotable lever for extracting a fired cartridge. The pivotable cam end plate may be connected to an independently pivotable arm that is operable as a lever for moving the cam end plate into an open position to allow breech access. The pivotable cam end plate and pivotable arm may be capable of a plurality of movements within the same plane in order to optimize leverage and cam action for opening the breech lock.

These and other aspects of the present invention will become more fully apparent from the following description and appended claims, or may be learned by the practice of the invention as set forth hereinafter.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings are not drawn to scale. The invention will be described and explained with additional specificity and detail through the use of the accompanying drawings in which.

DETAILED DESCRIPTION OF THE ILLUSTRATED EMBODIMENTS

Embodiments of the present invention include a breech system for a firearm comprising a breech lock with a pivotable end plate for accessing a firearm breech and/or a camming cartridge extractor with a pivotable lever.

Figure 1:
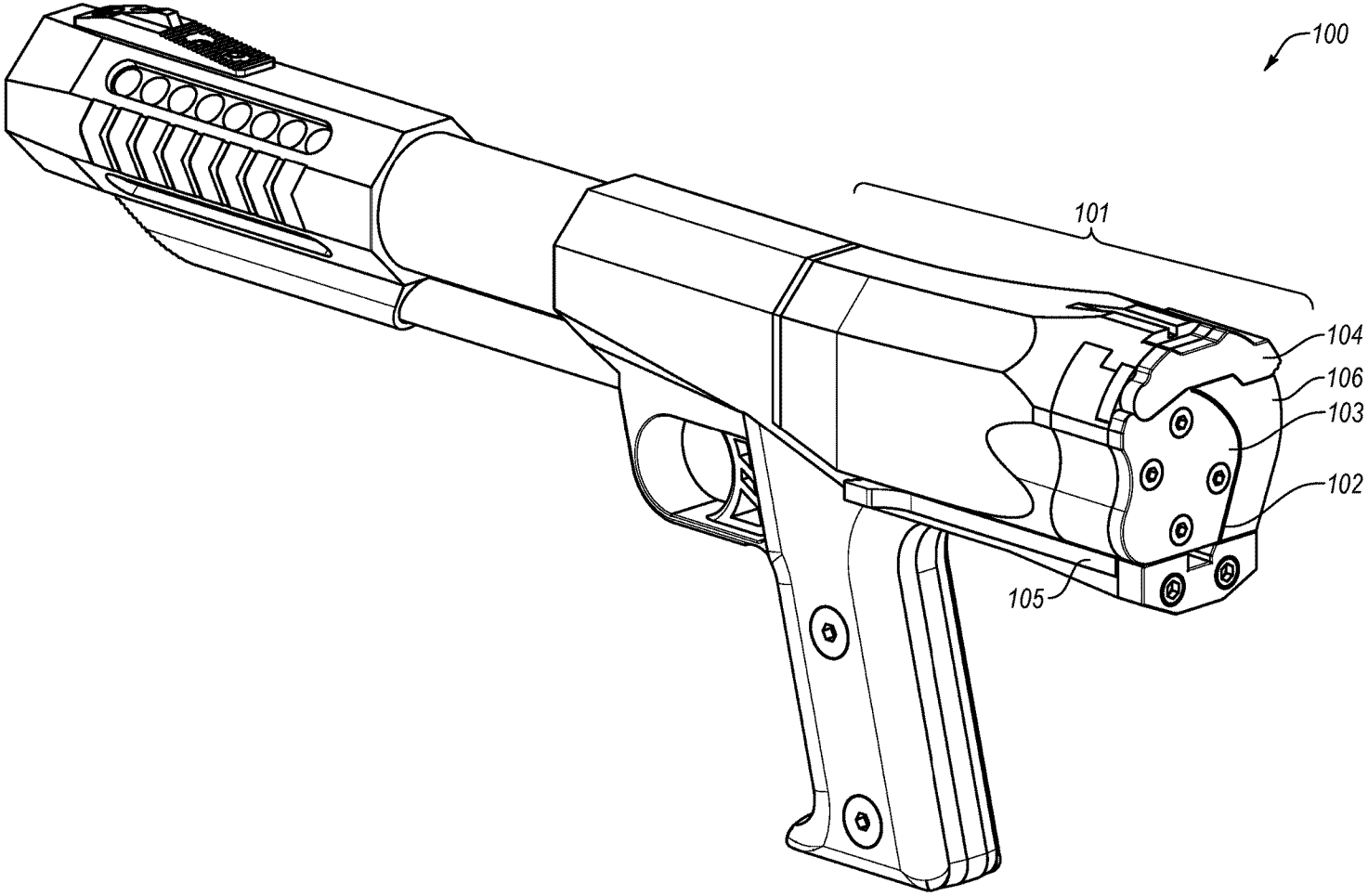
FIG. 1 shows an isometric view of one embodiment of a firearm breech system.

With attention now to FIG. 1, a breech system 101 for a firearm 100 is shown. In preferred embodiments, the breech system is optimal for a handgun chambered for outsized cartridges such as .50 BMG. However, the breech system may also be used for smaller cartridges and in long guns such as rifles. The system 101 includes a breech lock with a pivotable end plate 103 for accessing a firearm breech. Referring now to FIGS. 2 through 5, the pivotable end plate 103 is attached to the firearm 100 adjacent to, and pivots about, a plate hinge 201. In the particular embodiment shown, the plate hinge 201 is located adjacent to a lower left portion of the end plate 103.

Figure 6:
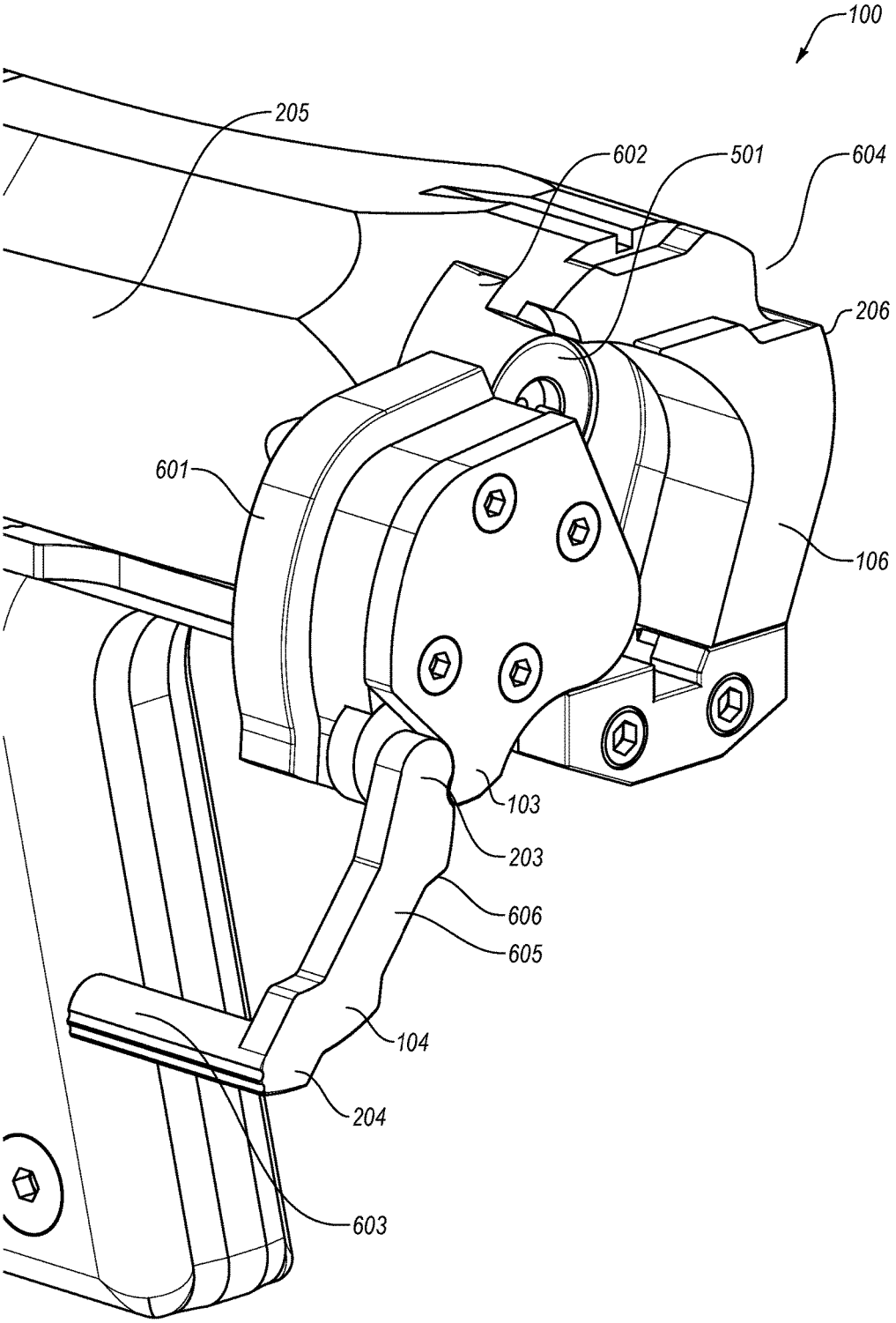
FIG. 6 shows a rear perspective view of one embodiment of one section of a firearm breech system with the breech lock in an open position.

Referring briefly to FIG. 6, the pivotable end plate 103 has a first key 601 on an outer surface portion. The first key 601 is operable to ride in a slot 602 located within the firearm 100. The first key 601 and slot 602 are configured to close and secure the breech lock.

Referring back to FIG. 1, the pivotable end plate 103 is further connected to an independently pivotable arm 104. The independently pivotable arm 104 is operable as a lever for moving the end plate 103 into an open position to allow breech access. In the illustrated embodiment, the independently pivotable arm 104 achieves this when it is pulled upwards and counterclockwise in relation to the firearm 100.

Referring now to FIGS. 2-5, the pivotable arm 104 is located adjacent to the top of the pivotable end plate 103 and pivots about a pivotable arm hinge 202 located adjacent to a first end 203 of the arm 104. The first end 203 of the pivotable arm 104 is located adjacent to a first side 205 of the firearm 100. To achieve a closed position I, the pivotable arm 104 is configured to fold over the firearm 100 and releasably lock the breech lock.

Referring again to FIG. 6, the releasable lock described above is achieved through a second key 603 located at a second end 204 of the pivotable arm 104. The second key 603 is configured to create a pressure fit within a second, opposite side 109 of a firearm 100 via a key indent 604. Depending on the embodiment, the pivotable arm 104 may have a detent-controlled releasable lock with one or more positions corresponding to the various pivotable arm movements described below.

Referring back to FIGS. 2-5, the pivotable end plate 103 and pivotable arm 104 are operable together such that a substantial upward and/or counterclockwise movement of the pivotable arm 104 within the arm's 104 overall range of motion corresponds to a substantially lesser movement of the pivotable end plate 103. This is accomplished through cam means, which is the use of a rotating or sliding piece such as an eccentric wheel or curved surface with irregular shape, against a follower, in a mechanical linkage, to achieve mechanical advantage through transformation of rotary motion into linear motion, leverage, or force. As explained in more detail below, embodiments of the invention use cam leverage for achieving mechanical advantage to open the breech lock against internal breech force caused by fired cartridge expansion.

Figure 2:
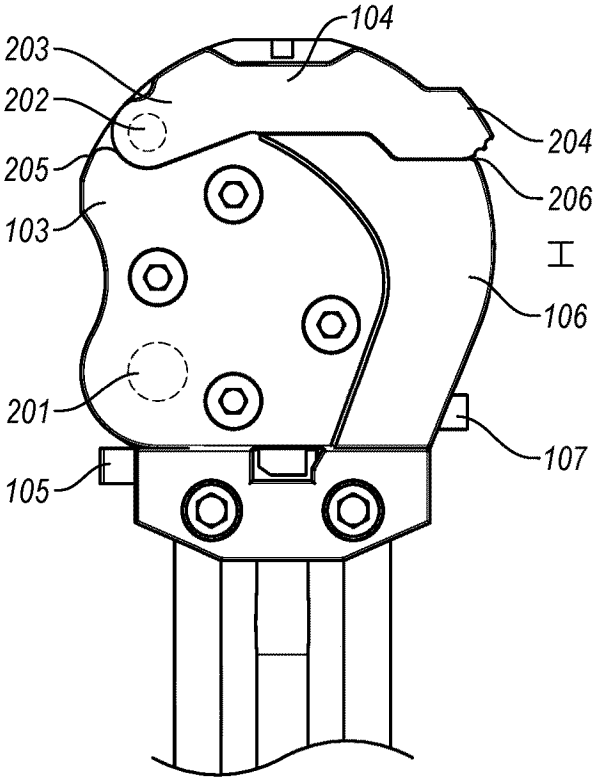
FIG. 2 shows a rear view of one embodiment of one section of a firearm breech system in a first position.

More specifically, FIG. 2 shows the arm 104 and plate 103 in a folded/nested or closed position I. From the folded/nested position I, the arm 104 is capable of a first movement A (see FIG. 3) whereby the second end 204 of the arm 104 unnests when it is pulled upward and/or counterclockwise. During this first movement and to achieve an unnested position II, the end plate 103 does not move.

Figure 3:
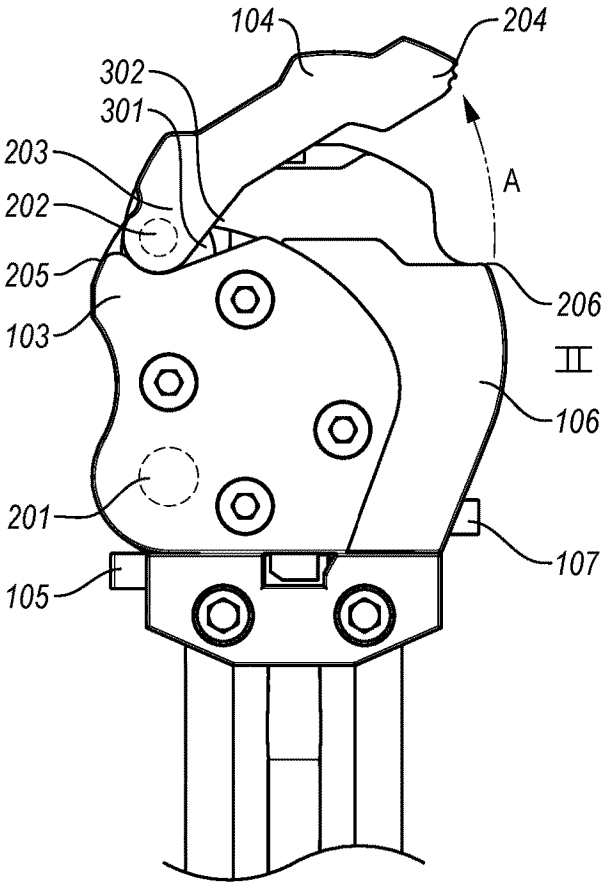
FIG. 3 shows a rear view of one embodiment of one section of a firearm breech system in a second position.
Figure 4:
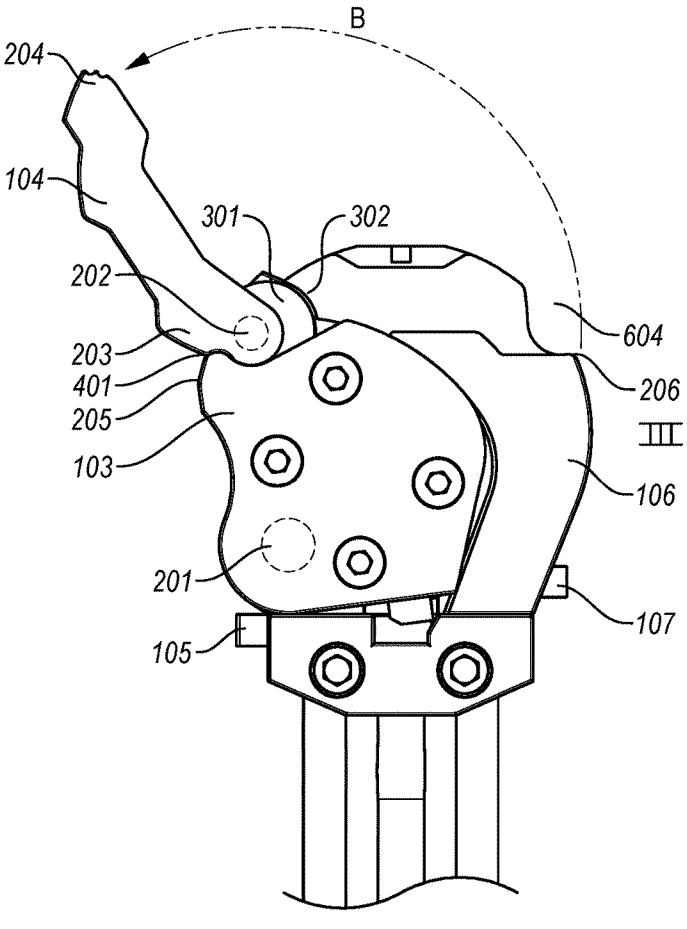
FIG. 4 shows a rear view of one embodiment of a firearm breech system in a third position.
Figure 13:
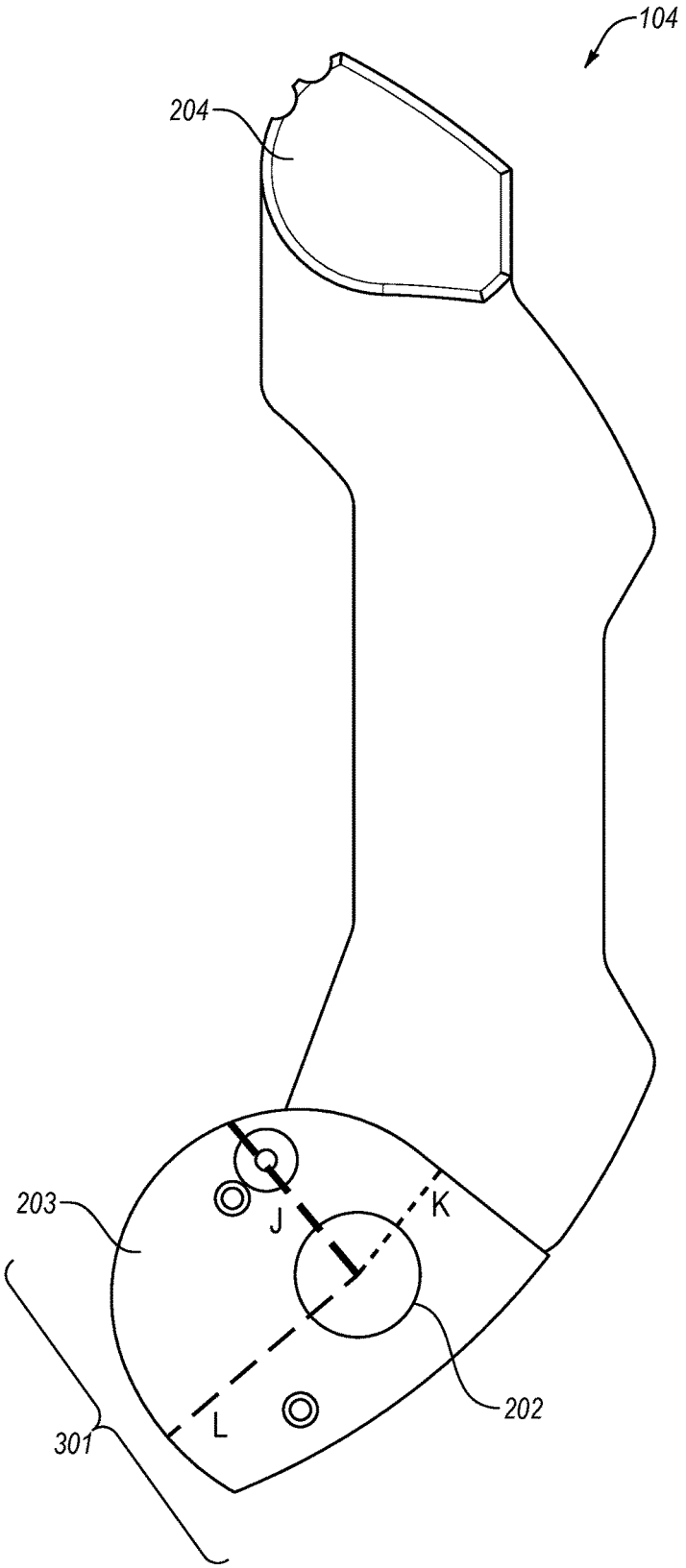
FIG. 13 shows a back view of the cam and pivotable arm components of one embodiment of the invention.

Referring to FIGS. 3 and 4, from movement A and the unnested position II, the arm 104 and end plate 103 are further capable of a second movement B whereby substantial continued upward and/or counterclockwise movement of the second end 204 of the arm 104 generates a cam leverage by causing a substantially lesser corresponding movement of the end plate 103 away from the firearm 100. In some embodiments, this cam leverage is accomplish through a cam 301 adjacent to the first end 203 of the arm 104, which engages a follower 302 adjacent to the gun frame, as the arm 104 moves from position I to position II. Referring briefly to FIG. 13, the cam 301 is shown with radii J, K, and L extending from the center of the pivotable arm hinge 202 in different directions, each radius having a different length, in part, determined as a function of the curvature of the cam 301. So configured, the arm 104 and plate 103 allow for an initial opening movement of the breech lock against considerable internal breech force caused by fired cartridge expansion, particularly that found in certain large caliber cartridges in handguns, for example, the .50 BMG. Specifically, in movement B of some embodiments, the second end 204 of the arm 104 moves approximately three inches while the plate 103 moves only three sixteenths of an inch in comparison, thereby resulting in several hundred pounds of cam leveraged force. Second movement B results in the end plate ajar position III.

Figure 5:
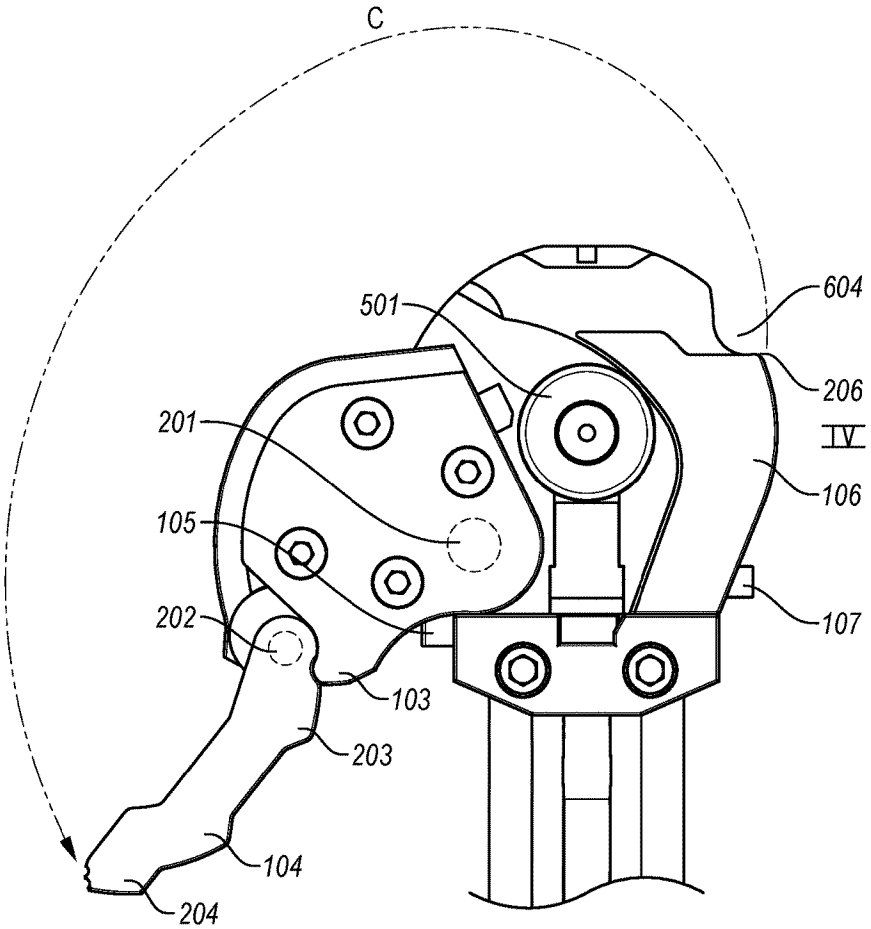
FIG. 5 shows a rear view of one embodiment of a firearm breech system in a fourth position.

Referring to FIGS. 4 and 5, from movement B, the arm 104 and plate 103 are further capable of a third movement C whereby, upon further counterclockwise movement, the first end 203 of the arm 104 and plate 103 engage at a stop 401 and then move synchronously together in parallel arcs. This results in a final opening movement of the breech lock that fully exposes the breech 501 and fired cartridge for retrieval and/or extraction. Third movement C achieves a fully open position IV.

As set forth above, in various embodiments, the pivotable end plate 103 and pivotable arm 104 are each capable of independent movement on separate axes. However, in preferred embodiments movement of the pivotable end plate 103 and pivotable arm are capable of movement only in a plane transverse to the firearm (i.e. perpendicular to the firearm's barrel) 100.

Figure 7:
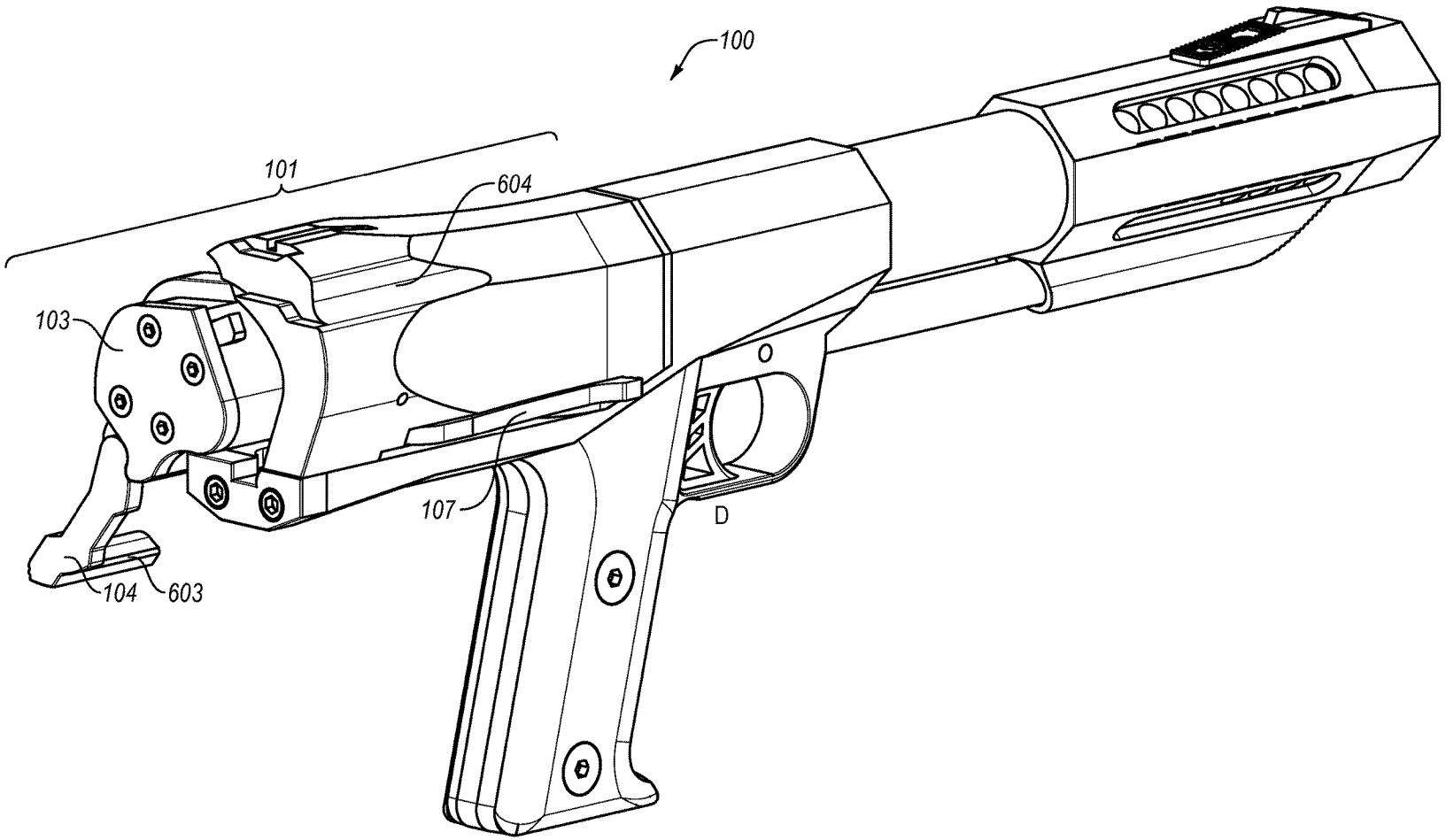
FIG. 7 shows a rear perspective view of one embodiment of one section of a firearm breech system camming cartridge extractor with pivotable lever in a first, closed position.
Figure 8:
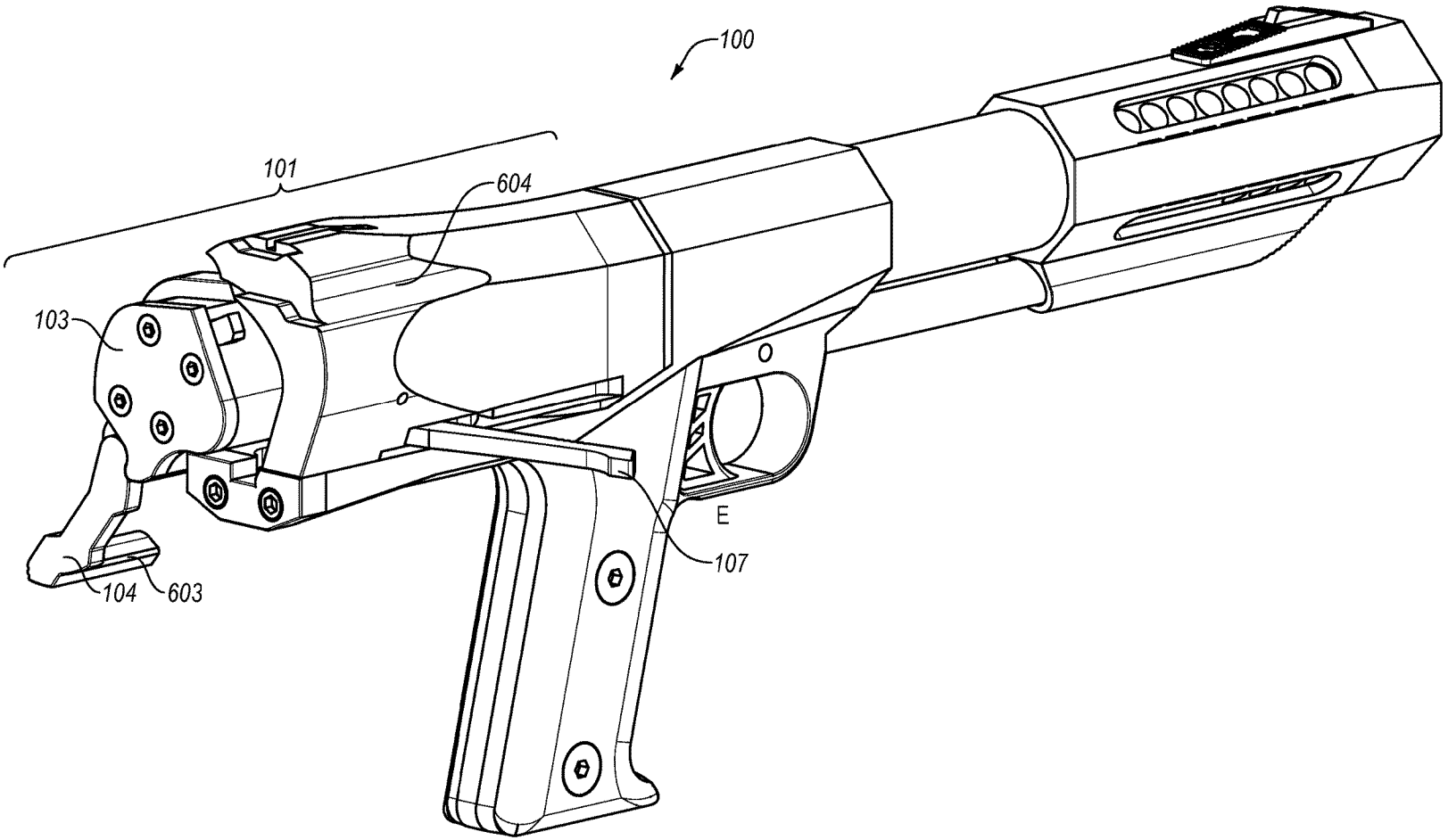
FIG. 8 shows a rear perspective view of one embodiment of one section of a firearm breech system camming cartridge extractor with pivotable lever in a second, open position.

Referring now to FIG. 7, the system 101 further includes a camming cartridge extractor with a pivotable lever 107 for extracting an expended cartridge once the breech lock is opened. In preferred embodiments, the pivotable lever 107 is operable only in a plane longitudinal to the firearm 100, and in particular from a closed position D (see FIG. 7) to an opened position E (see FIG. 8).

Figure 9:
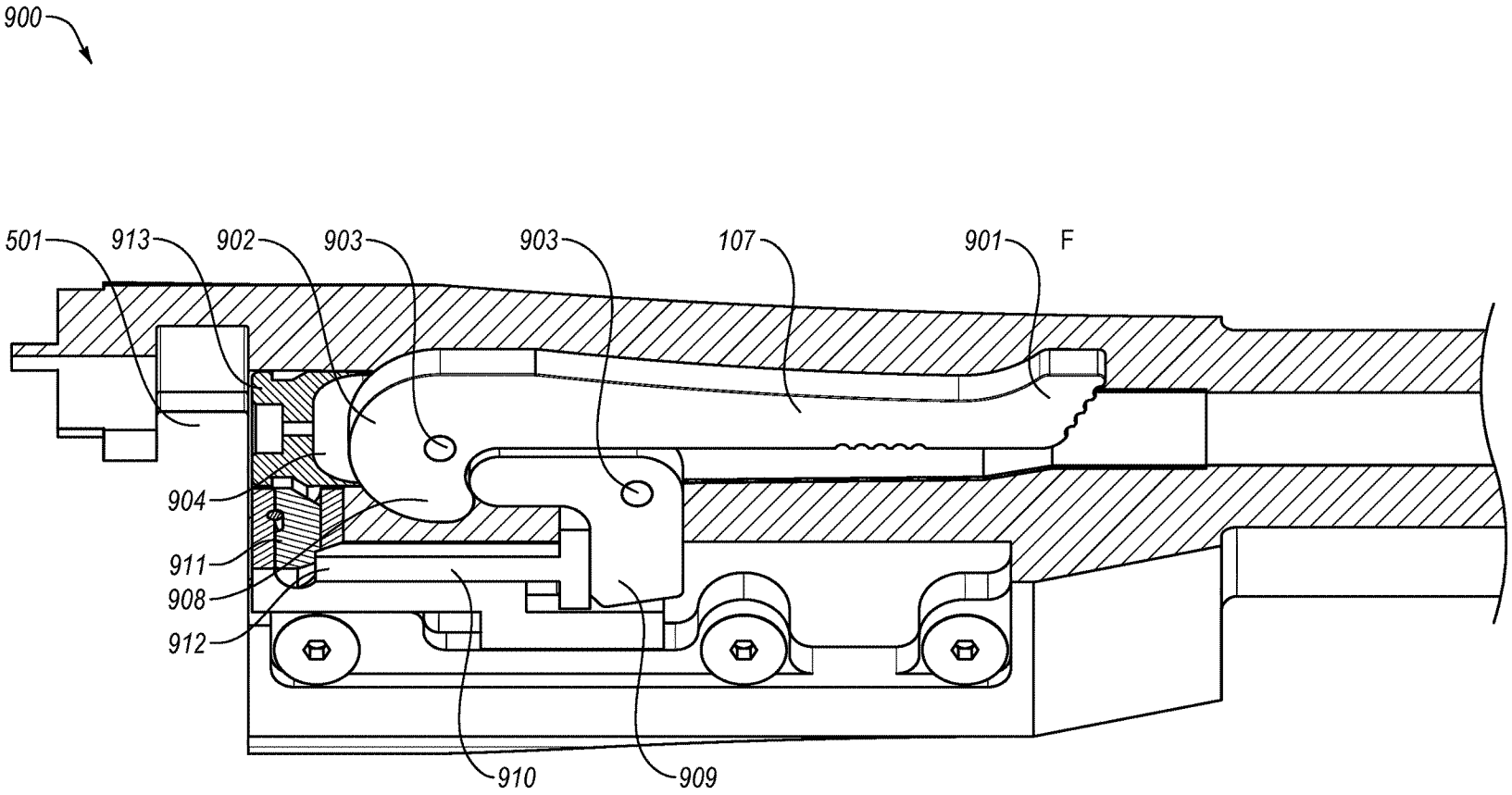
FIG. 9 shows a partial cross-section view of one embodiment of a firearm breech system camming cartridge extractor with pivotable lever in a first, closed position.

Referring now to FIG. 9, the interior detail of the camming cartridge extractor 900 is shown in partial cross-section within a closed position F. The pivotable lever 107 has a first swinging end 901 and a second hinged end 902. The second hinged end 902 has a camming end 908 configured such that a substantial movement of the first swinging end 901 corresponds to a substantially lesser movement of the camming end 908. In the illustrated embodiment, the camming end 908 of the extractor 900 is adjacent to and in communication with a pivoting, hinged leg 909, which is in turn, in communication with and adjacent to a primary extractor pin 910. The primary extractor pin 910 is in communication with and adjacent to a secondary extractor pin 911. The secondary extractor pin 911 is operable to engage the extraction groove of an expended cartridge 913 upon an initial movement of the pivotable lever 107. So configured, movement of the pivotable lever 107, as further described below, can generate significant forces necessary to remove an expanded, large caliber round from a firearm breech.

Figure 10:
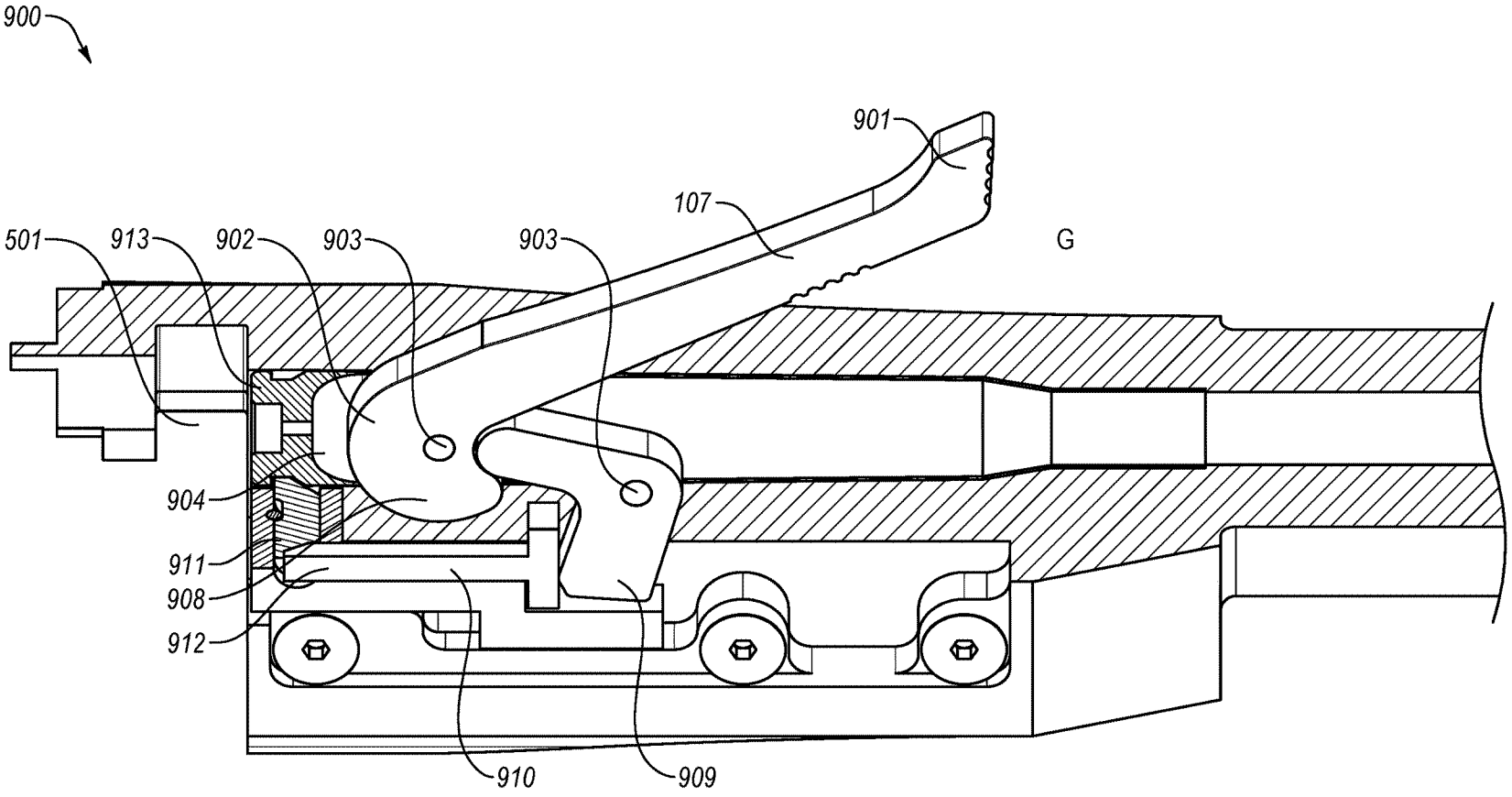
FIG. 10 shows a partial cross-section view of one embodiment of a firearm breech system camming cartridge extractor with pivotable lever in a second, partially open position.
Figure 11:
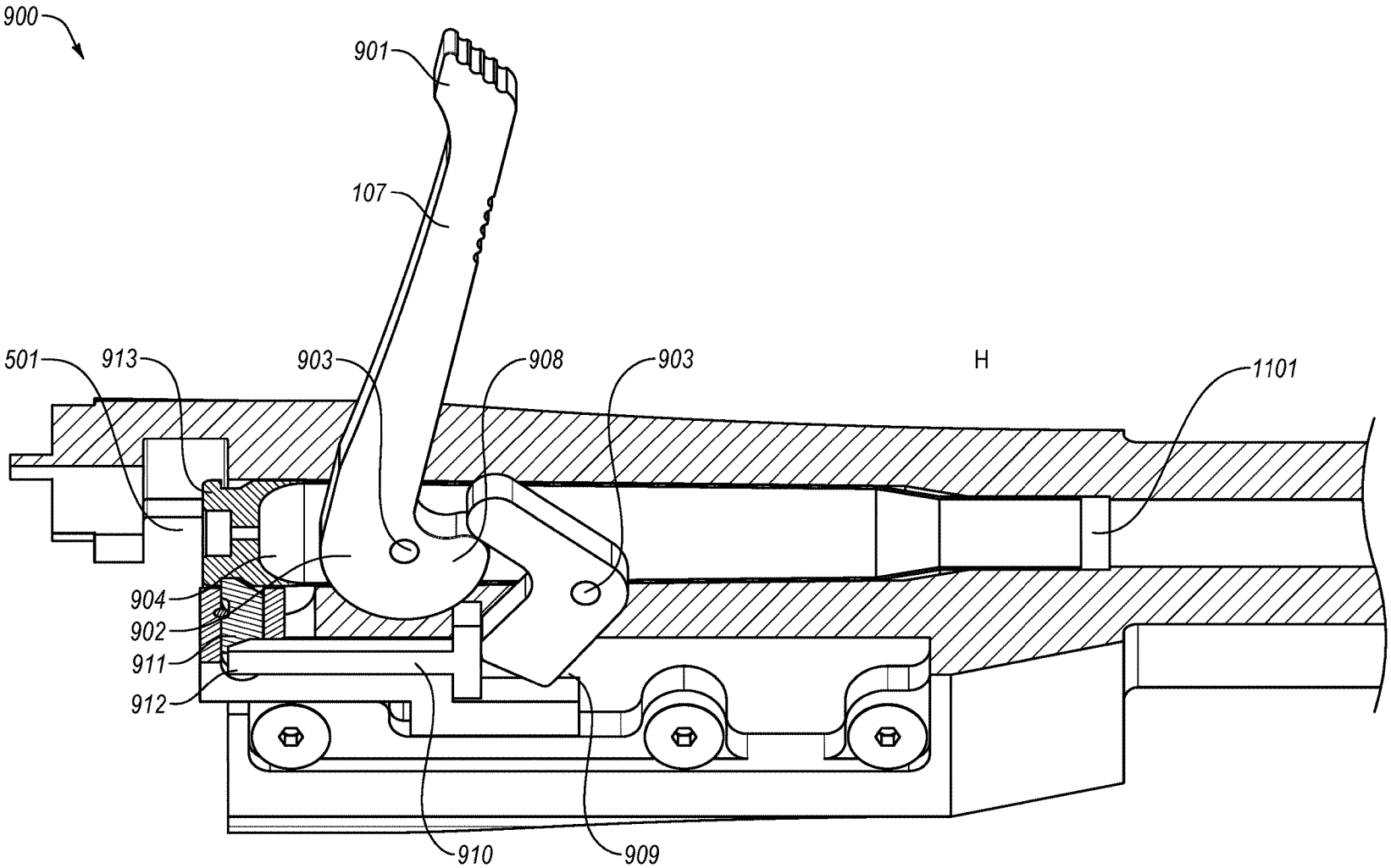
FIG. 11 shows a partial cross-section view of one embodiment of a firearm breech system camming cartridge extractor with pivotable lever in a third, open position.

More specifically, referring now to FIG. 10, within the camming cartridge extractor 900, first movement of the pivotable lever 107 to position G causes the secondary extractor pin 911 to engage the extraction groove of an expended cartridge 913. Referring to FIG. 11, a second movement of the pivotable lever 107 to position H, causes the secondary extractor pin 911 to move the now engaged cartridge slightly rearward from the barrel into the breech 501, loosening it sufficiently to allow an operator to remove the loosened cartridge by hand.

Figure 12:
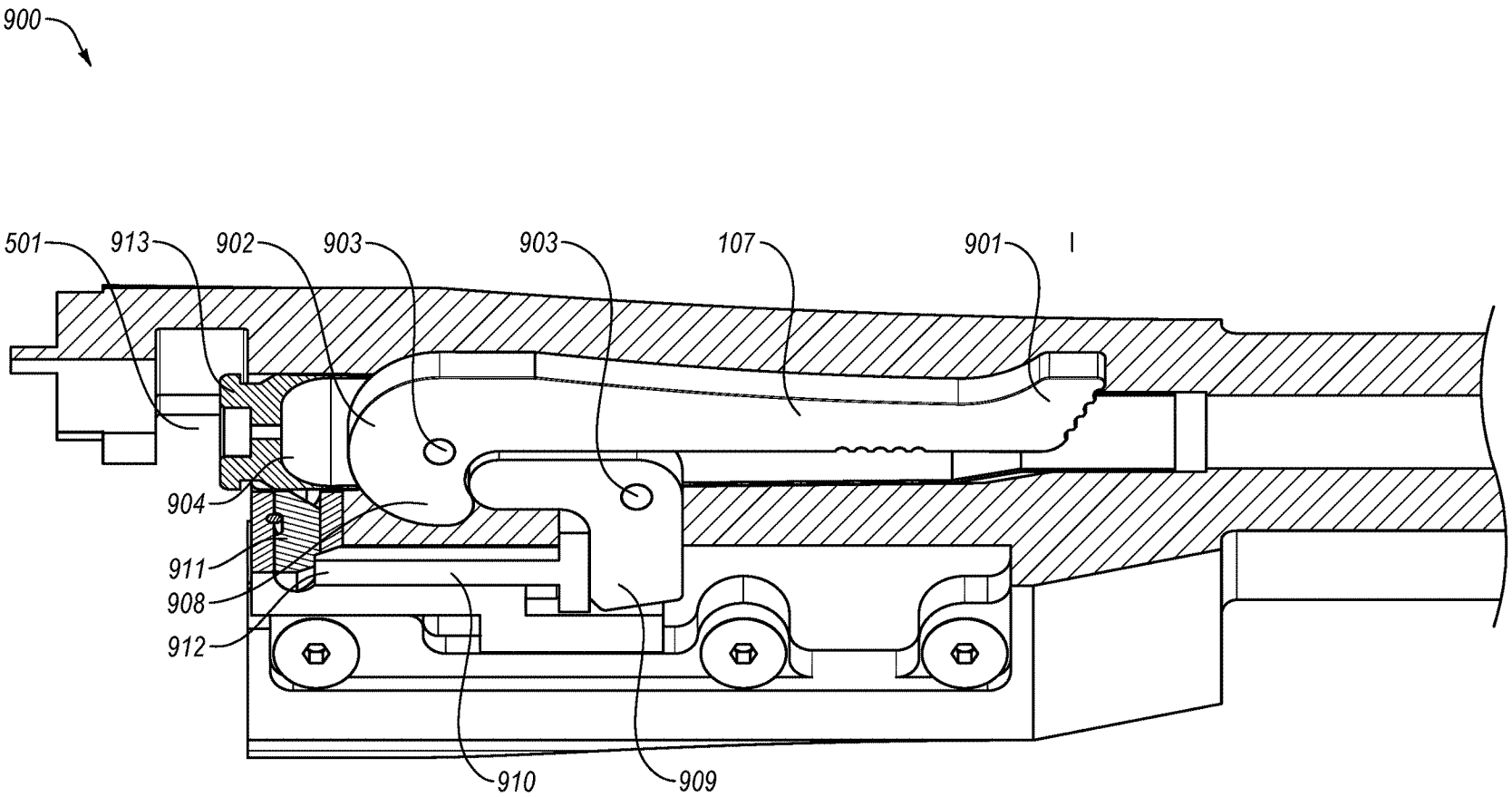
FIG. 12 shows a partial cross-section view of one embodiment of a firearm breech system camming cartridge extractor with pivotable lever in a first, closed position with a cartridge partially extracted.

FIG. 12 then shows the pivotable lever 107 returned to a position I, essentially the same position as closed position F, except that the expended cartridge 913 is now loosened, and an operator may now remove the loosen the cartridge by hand.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A breech system for a firearm comprising a breech lock with a pivotable end plate for accessing a firearm breech, the system further comprising a pivotable arm that is operable as a lever for rotating a cam means for achieving mechanical advantage to open the end plate against internal breech force caused by fired cartridge expansion, and the pivotable end plate and pivotable arm configured to move only in a plane transverse to a longitudinal axis of the firearm.

2. The breech system of claim 1, the pivotable arm further configured to fold over the firearm and releaseably lock the breech lock when folded.

3. The breech system of claim 1, the system further having a slot within a firearm frame, the pivotable plate having a first key operable to ride in the slot.

4. The breech system of claim 1, wherein the pivotable end plate and pivotable arm are operable together such that rates of rotation of the pivotable arm and end plate about respective axes differ as a function of cam rotation.

5. The breech system of claim 2, the pivotable arm when folded having a first end located adjacent to a first side of the firearm and a second end located adjacent to a second, opposite side of the firearm, the first end having a hinge and the second end having a second key configured to fit within the second, opposite side of a firearm.

6. The breech system of claim 1, further having a first movement whereby the pivotable arm unnests when it is pulled and wherein the end plate does not move.

7. The breech system of claim 1, further having a second movement whereby rates of rotation of the pivotable arm and end plate about respective axes differ as a function of cam rotation.

8. The breech system of claim 7, further having a third movement whereby the pivotable arm and end plate move synchronously in parallel arcs.

9. The breech system of claim 1, wherein the firearm is chambered for a .50 BMG handgun.

10. The breech system of claim 1, wherein the firearm is a handgun.

11. A breech system for a firearm comprising a breech lock with a pivotable end plate for accessing a firearm breech, the pivotable end plate connected to the firearm through a stationary hinge, and further connected to a pivotable arm configured to fold over a firearm and releaseably lock the breech lock when folded, and the system further comprising the pivotable arm is operable as a lever for rotating a cam means in a mechanical linkage for achieving mechanical advantage to open the end plate against internal breech force caused by fired cartridge expansion, and the pivotable end plate and pivotable arm configured to move only in a plane transverse to a longitudinal axis of the firearm.

12. The breech system of claim 11, wherein the pivotable end plate and pivotable arm are operable together such that rates of rotation of the pivotable arm and end plate about respective axes differ as a function of cam rotation within at least a portion of the overall range of motion of the arm and end plate.

13. The breech system of claim 11, wherein the pivotable arm has a detent-controlled releasable lock with one or more positions.

* * * * *